US010513870B1

(12) United States Patent
Jackson

(10) Patent No.: US 10,513,870 B1
(45) Date of Patent: Dec. 24, 2019

(54) PORTABLE HOME BARRIER

(71) Applicant: Luke Jackson, St. Johns, FL (US)

(72) Inventor: Luke Jackson, St. Johns, FL (US)

( * ) Notice: Subject to any disclaimer, the term of this patent is extended or adjusted under 35 U.S.C. 154(b) by 520 days.

(21) Appl. No.: 15/431,835

(22) Filed: Feb. 14, 2017

(51) Int. Cl.

| | |
|---|---|
| ***E04H 17/18*** | (2006.01) |
| ***E04H 17/04*** | (2006.01) |
| ***E04H 17/08*** | (2006.01) |
| ***E04H 17/12*** | (2006.01) |
| ***E01F 13/02*** | (2006.01) |

(52) U.S. Cl.
CPC ..... *E04H 17/18* (2013.01); *E01F 13/022* (2013.01); *E04H 17/04* (2013.01); *E04H 17/08* (2013.01); *E04H 17/12* (2013.01)

(58) Field of Classification Search
CPC ..... E01F 13/02; E01F 13/022; E01F 13/024; E01F 13/028; E01F 13/04; E04H 17/18; E04F 11/1802; E04F 11/1804
See application file for complete search history.

(56) References Cited

U.S. PATENT DOCUMENTS

| | | | | |
|---|---|---|---|---|
| 7,377,490 | B1 * | 5/2008 | Khosravian | E01F 13/028 119/416 |
| 7,438,112 | B2 * | 10/2008 | Cheng | E01F 13/028 160/24 |
| 8,991,470 | B1 * | 3/2015 | Pacheco | G08B 3/00 160/240 |
| 2005/0098770 | A1 * | 5/2005 | Schell | E01F 13/028 256/25 |
| 2006/0180284 | A1 * | 8/2006 | Wiggins | E06B 9/02 160/368.1 |
| 2012/0018691 | A1 * | 1/2012 | Roth | E01F 13/028 256/21 |

FOREIGN PATENT DOCUMENTS

| | | | | |
|---|---|---|---|---|
| CH | 682 759 | * 11/1993 | | E04H 17/18 |
| WO | WO 97/13049 | * 4/1997 | | E01F 13/02 |

* cited by examiner

*Primary Examiner* — Michael P Ferguson
(74) *Attorney, Agent, or Firm* — Lawrence J. Gibney, Jr.

(57) ABSTRACT

One of the primary jobs of parents is to keep their children safe. Since most children play around their own home a portable home barrier will allow a parent to block off an area that is safe for children. The barrier is also designed to be portable and can be moved around the home to enclose a porch or deck or similar area.

2 Claims, 8 Drawing Sheets

PORTABLE HOME BARRIER

FIELD OF THE INVENTION

One of the greatest concerns for parents is to keep their children safe, particularly when they are outdoors. Often children are playing around their own home but are out of the sight of a parent or guardian yet still need to be protected. This portable home barrier insures that children will stay in a predetermined area for their own protection and the peace of mind of the parent. The portable home barrier is designed to be portable and is also constructed to withstand all environmental conditions.

PRIOR ART

There are many other prior art references to portable post and fencing systems and a representative example of this can be found at Penning U.S. Pat. No. 7,562,865. Another example in the prior art is a folding pet crate that can be found at Flannery U.S. Pat. No. 8,267,048.

BRIEF SUMMARY OF THE INVENTION

Parents want to keep children safe particularly outside and around the garage and yard area. It is important for the parents to be able to monitor and ensure that the children play in a safe environment for their own piece of mind.

Typically when children are outside they tend to congregate around the driveway or garage or in a backyard usually as requested by the parents. This device is a portable retractable system that can be secured to mounting brackets on the frame of a garage or by other connection pieces that have been installed in other parts of the house.

A series of stanchions with are secured to the garage and provide netting that can be configured to provide an area in which the child or children can be protected. The length of the netting as well as the height of the netting can be adjustable depending on the area to be protected.

The configuration of the specific area can be adjusted depending on the configuration that is desired by the user.

In addition to being able to secure an area, other features of the device may include a video monitoring as well as audio monitoring of the activity in the garage or on the driveway or in other areas where children may congregate and play.

When the device is not used it will be stored conveniently in the garage while still installed on the brackets or removed from connection pieces in other parts of the home and stored in the garage.

NUMBERING REFERENCES

Figure 1:
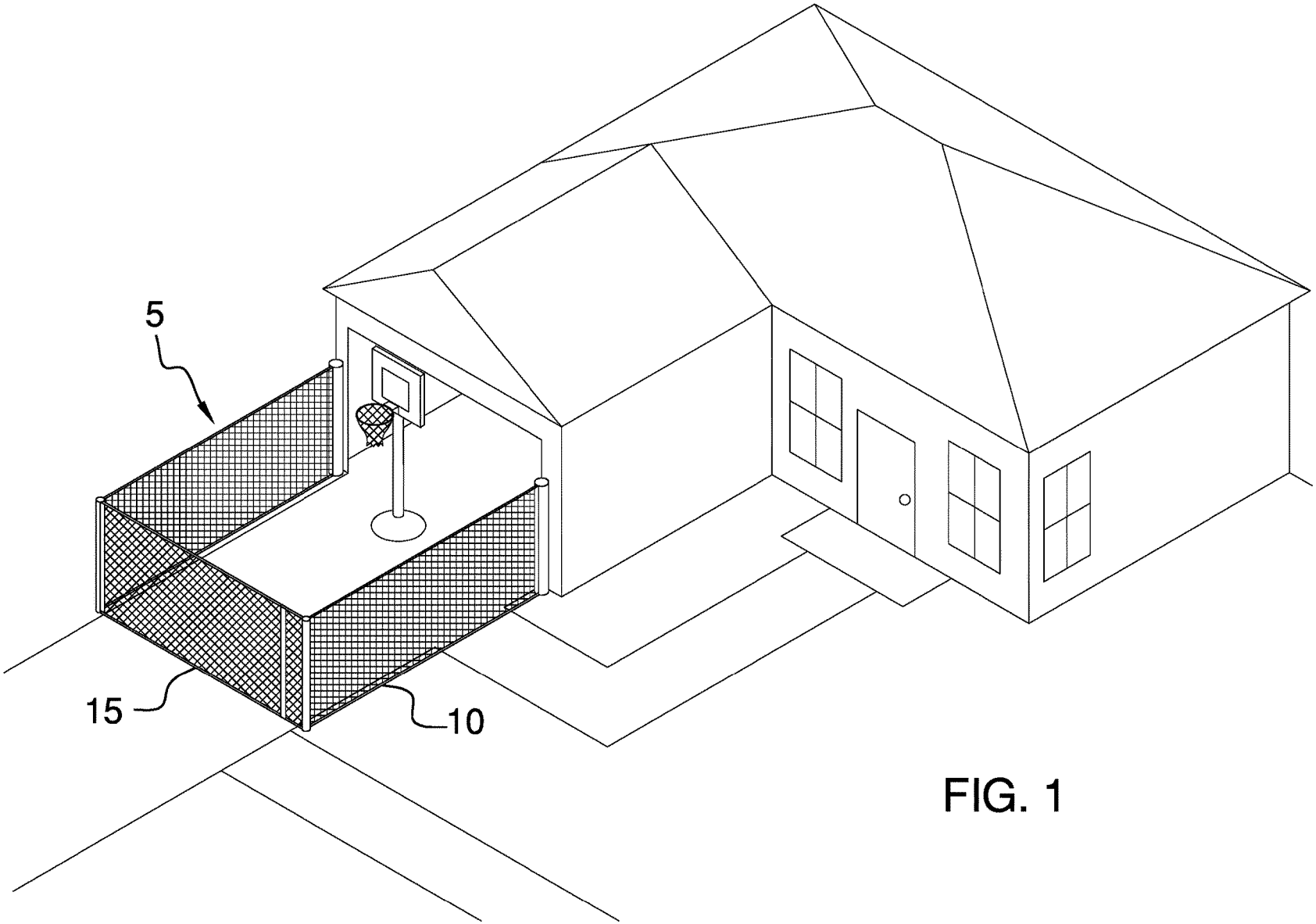
FIG. 1 is an isometric view of the device installed around the opening of a house garage.

5 Device
10 Panels
15 Panel with zipper
16 Zipper
17 Bracket
18 Ratchet bracket
20 Tube with netting
25 Bracket
27 Post
30 Cotter pin
35 Bracket Arm
45 Tubular Female Connector
55 Wall Mount
60 Wall Mount Connection Piece
61 Opening for grommet
65 Male Coupler
67 Spring Loaded Grommet
70 Sliding pivot bracket

DETAILED DESCRIPTION OF THE EMBODIMENTS

This device 5 will allow parents or guardians to protect their children while at home and particularly in open spaces outside and in the immediate vicinity of the home. This device 5 will consist of a series of panels 10 that are contained in tubes 20 or canisters. The panels 10 are comprised of netting, which retract and roll up inside the tube 20. The netting is likely made from mesh material. Regardless of the choice of material, it should be able to confine children within a designated space.

Although no specific type of netting is being claimed, it should be durable enough to withstand some wind, rain, or moving ball without breaking down or collapsing. Another consideration is that the netting should be relatively lightweight and the parent or guardian should be able to see through the netting material. However, it is anticipated that some or all panels may be non-transparent or see-through.

Figure 2:
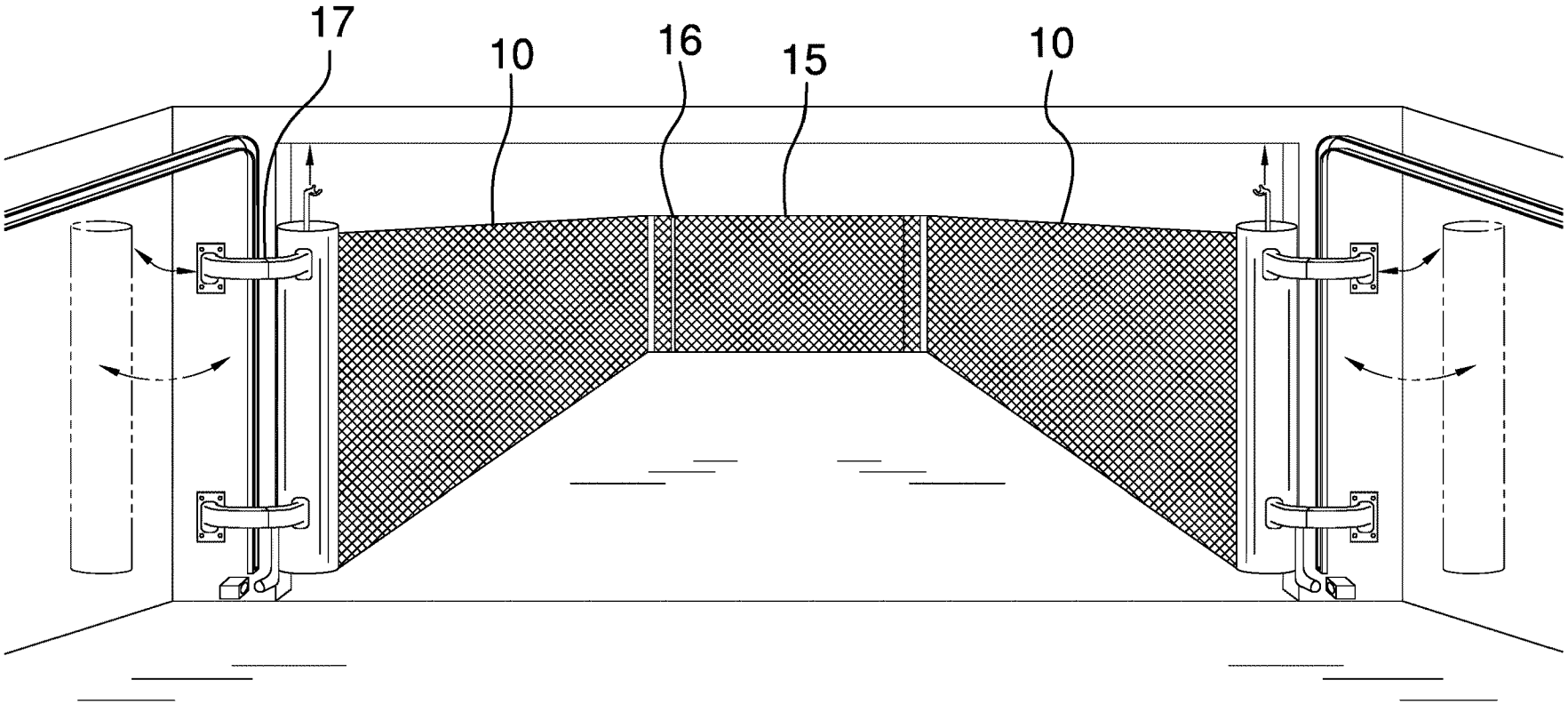
FIG. 2 is a view of the device from the inside of the garage depicting the brackets as installed in the garage.

One end of the tube will be connected to the interior of the wall of the garage using a bracket 17 which is designed to rotate outward in order to enable the homeowner to install the device such as depicted in FIG. 2. The bracket itself is designed to fold conveniently and use the least amount of space. When the device is not being used, the tube can be rotated inwards and stored in the garage space to minimize the space of the tube when it is not being used.

Figure 7:
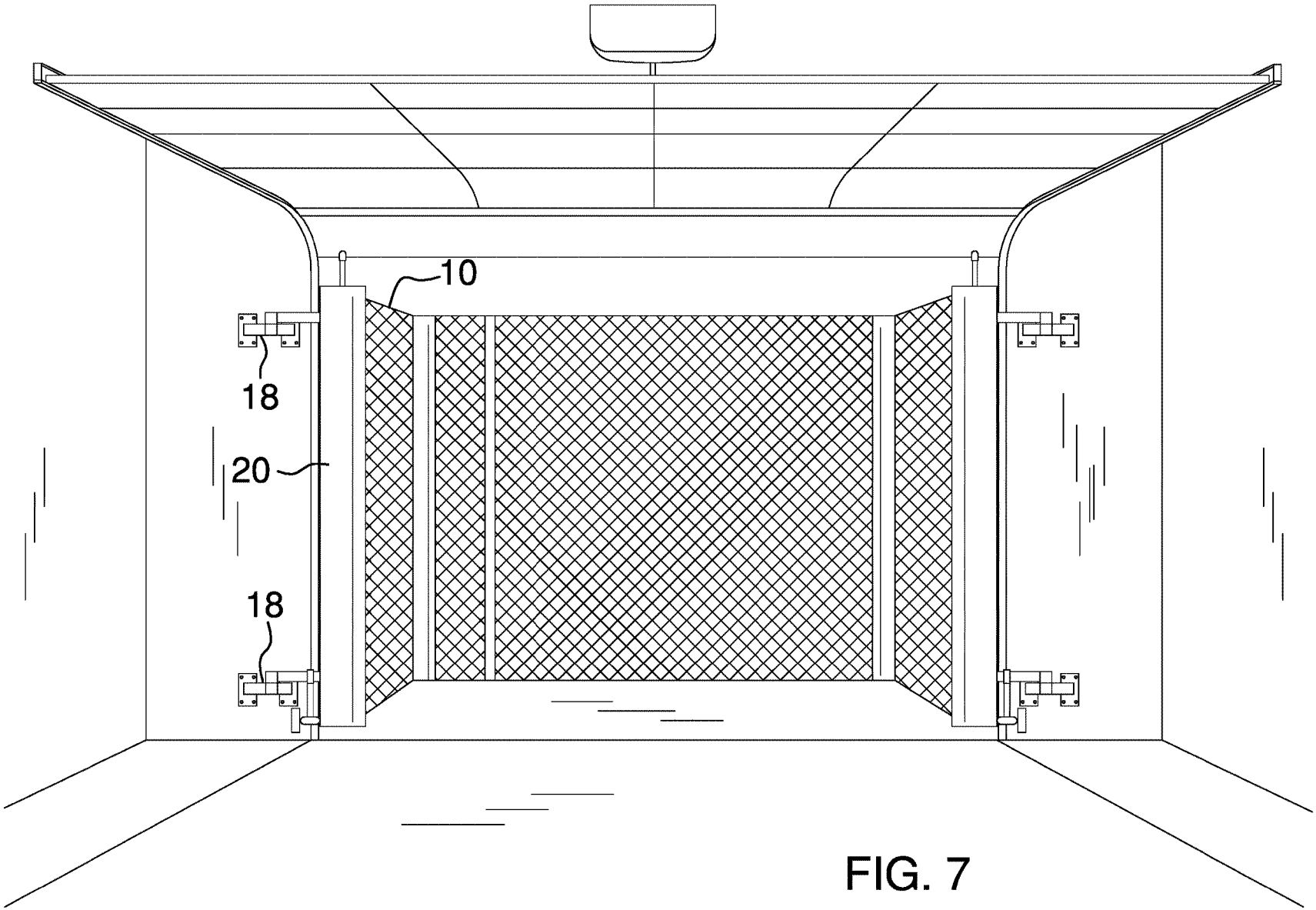
FIG. 7 is a view from the interior of the garage with the device installed depicting the brackets.
Figure 8:
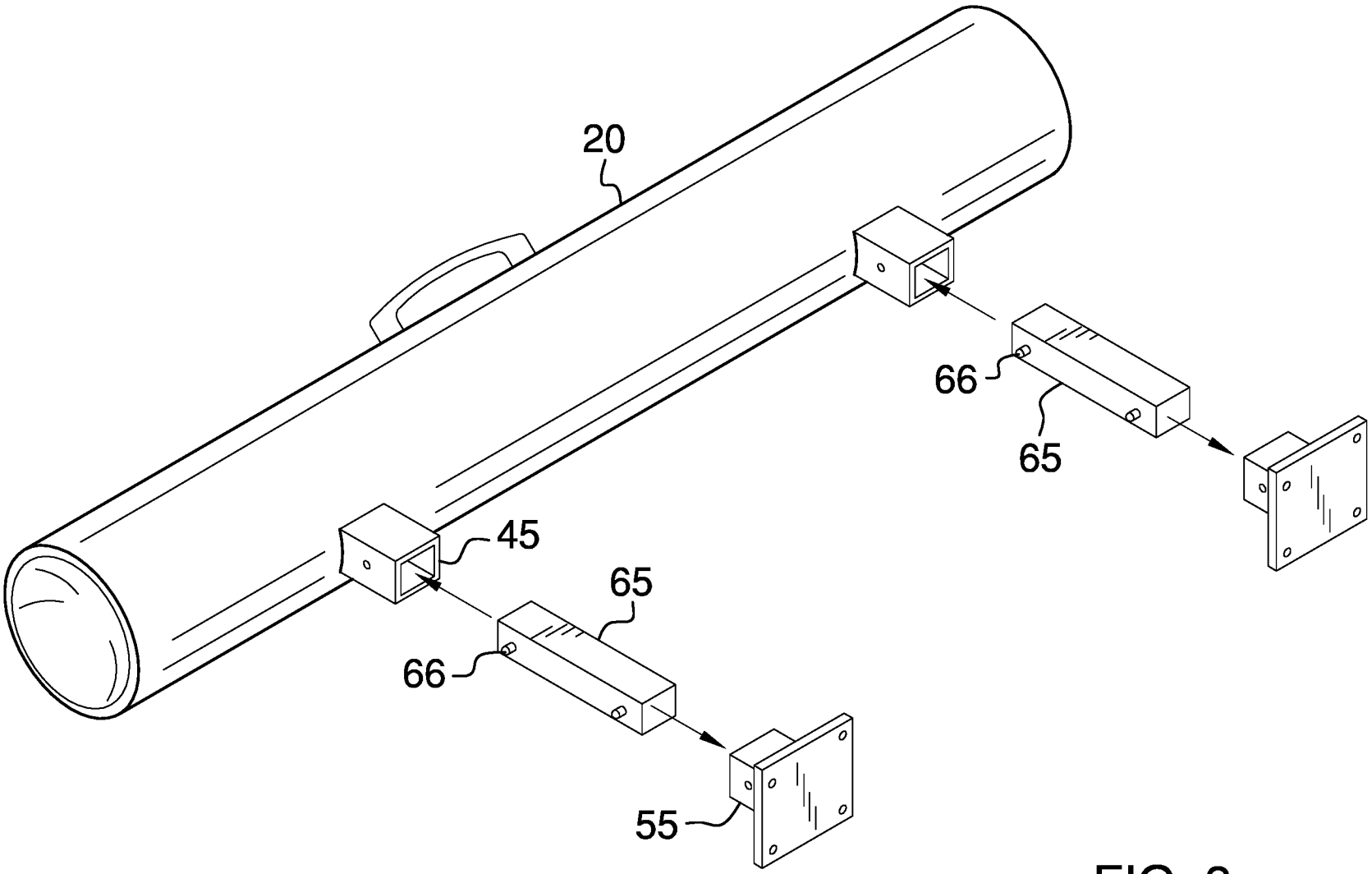
FIG. 8 is an isometric view of the tube with the netting depicting the bracket mounts that will be used in the interior of the home.

A ratcheting bracket 18 may alternatively be used with this device, as shown in FIG. 7.

As depicted in FIGS. 1 and 2, the panels 10 will allow a parent to enclose a predetermined area; the length of the netting can be adjusted to different lengths so that the parent can adjust the length of the space to be enclosed. Two separate tubes with netting that will connect together at the end of the respective sections of the netter will be used to create the enclosed area such as shown in FIG. 2. Posts to secure the panel will also be provided to secure one end of the netting into the ground at a predetermined location. The panels 10 can be secured with a hook and loop assembly, snaps, or straps. Other items may additionally or alternatively be utilized to securely attach the panels to the posts.

As depicted in FIG. 1 there are two side panels 10 and a front panel 15. The front panel 15 will also contain a zipper 16 which will allow the front panel to be opened without dismantling the entire structure. This may become necessary in the event somebody needs to take a piece of equipment out of the garage or put in a piece of equipment into the garage.

Figure 3:
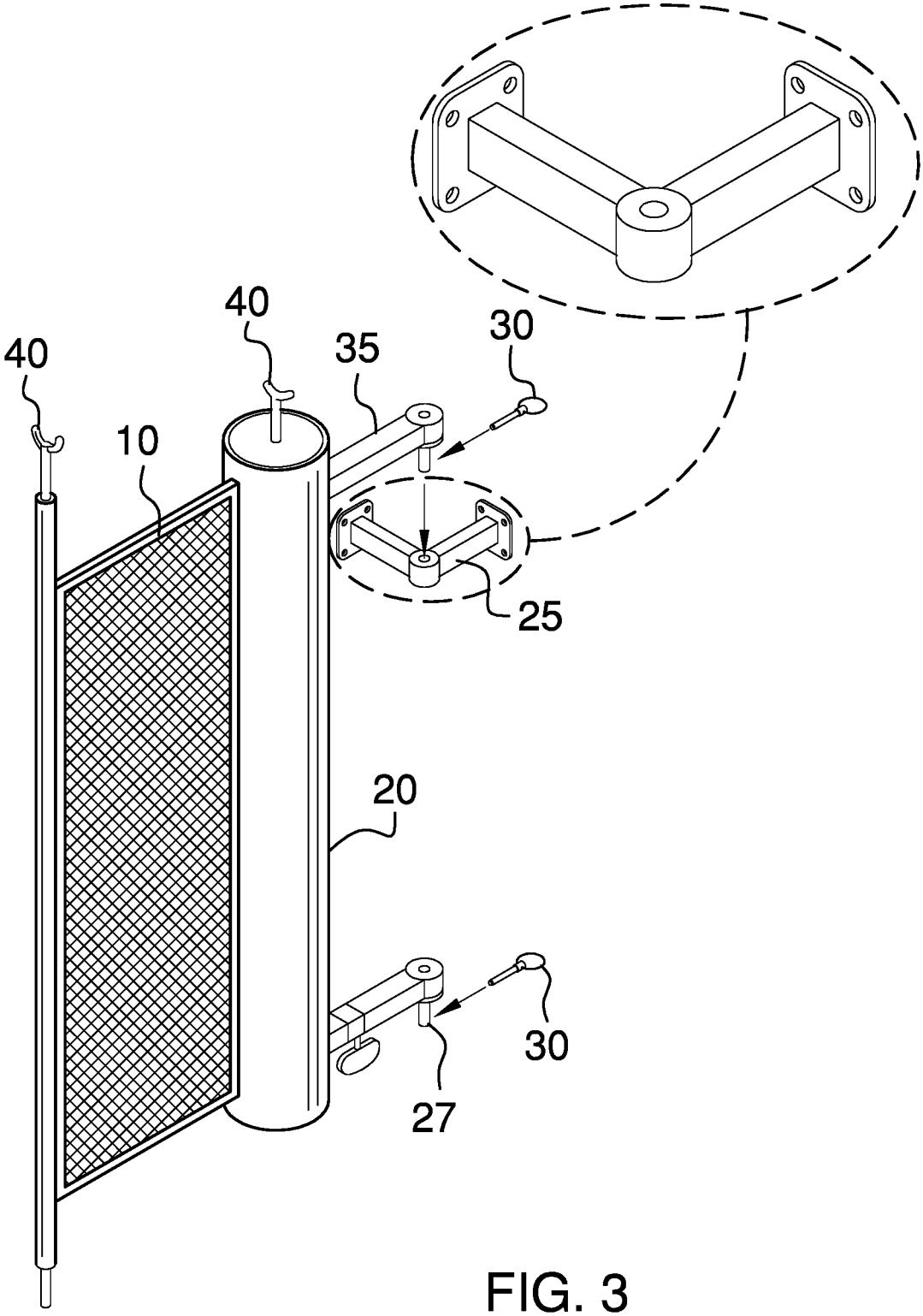
FIG. 3 is an isometric view of the ratchet bracket that will be secured to the interior of the garage and its relationship with the canister that contains the netting.

One of the brackets that will be used in the garage is depicted in FIG. 3. The sides of the bracket 25 will be secured to the garage walls and a bracket arm 35 will secure the tube with the netting to the bracket 25 by inserting the post 27 through the opening of the bracket 25. A cotter pin 30 and a post 27 which is on the bracket arm will insure that the bracket in place during normal use. Although a cotter pin 30 is discussed there may be other means to insure that the bracket remains attached to the tubing with the netting.

Figure 4:
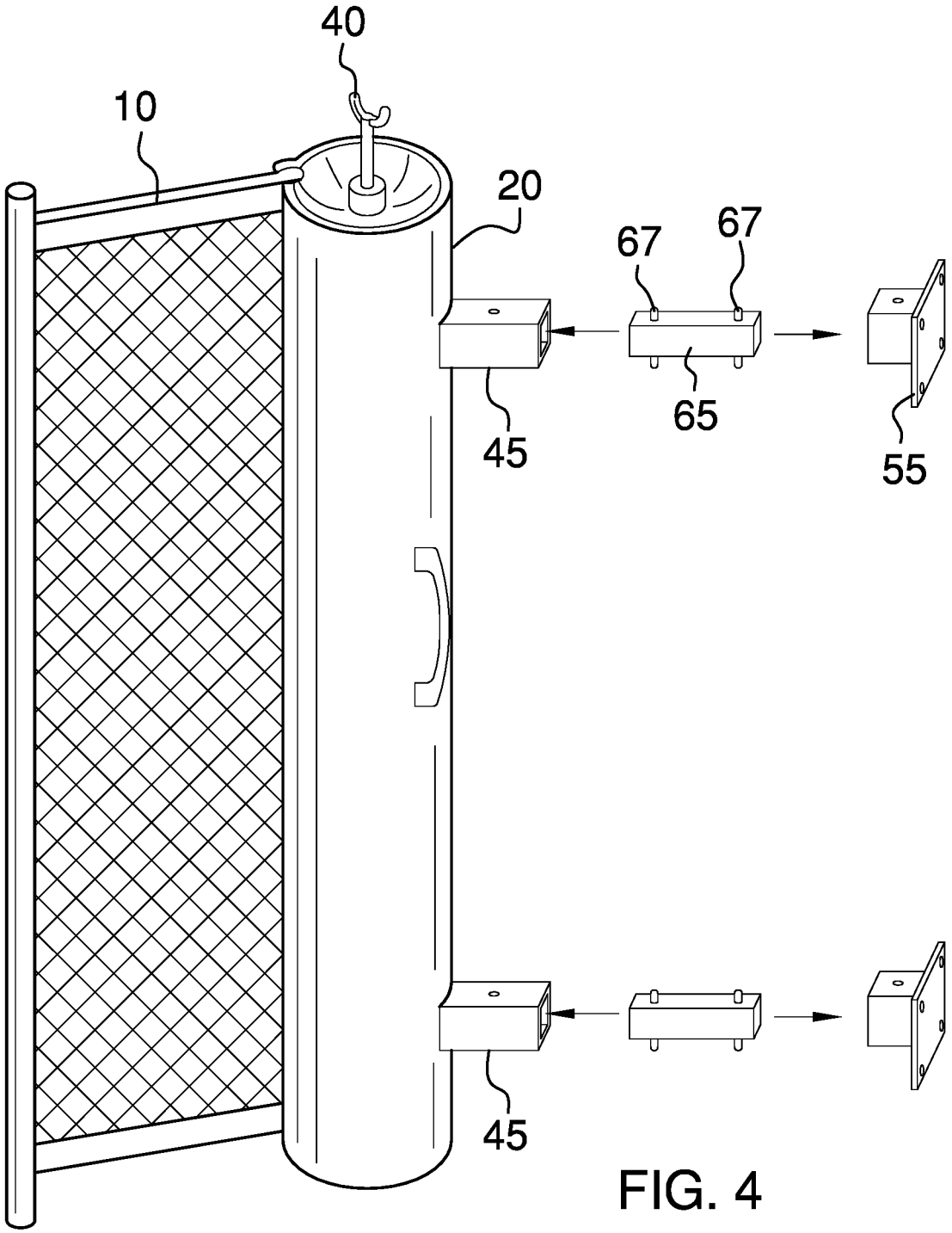
FIG. 4 is an front view of a canister with the attachment points that will be used in other areas of the house.
Figure 5:
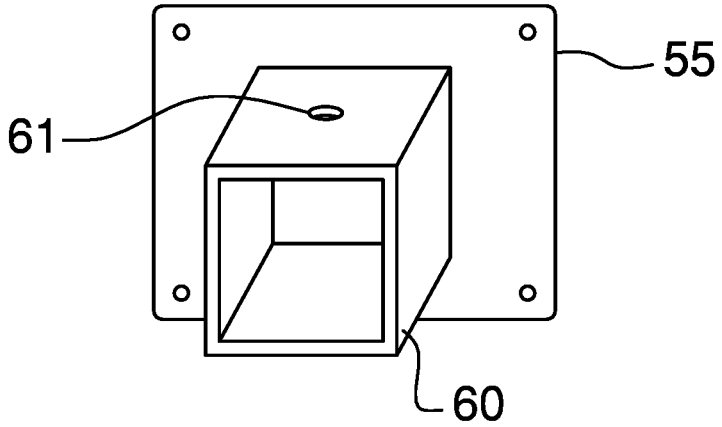
FIG. 5 is a front view of the wall mount.
Figure 6:
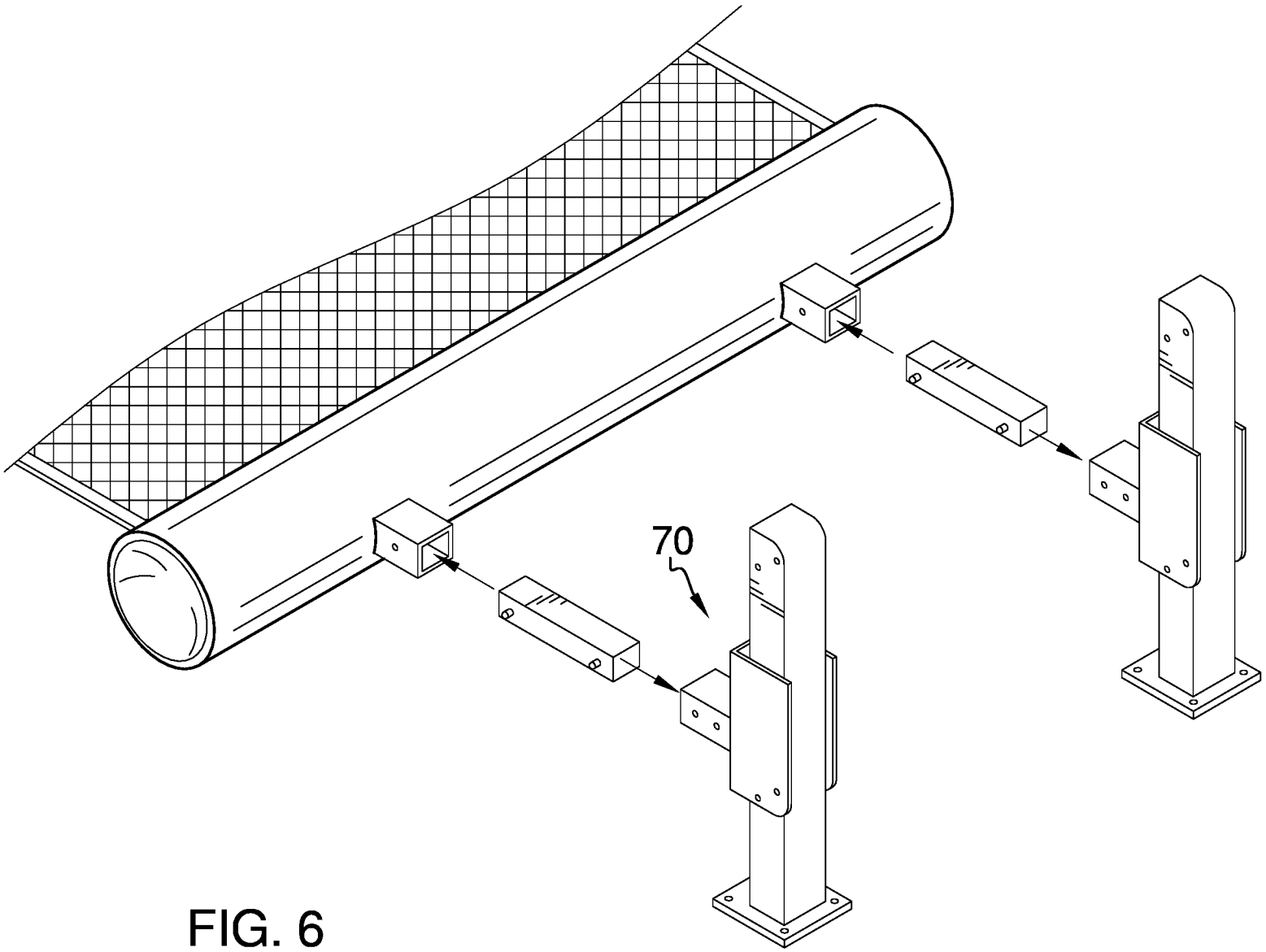
FIG. 6 is an isometric view of the canister and the brackets that will be used with the alternative embodiment.

The tube with the netting is designed to be portable and can be placed in other areas such as decks or porches using a wall mount 55, which is flanged with apertures to secure the wall mount 55. A tubular female connector 45 on the tube 20 will connect the tube with the wall mount 55 using a male coupler 65 such as depicted in FIG. 4. The male coupler 65 is equipped with a plurality of spring loaded grommets 67 that will secure the male coupler by inserting the grommet into the opening 61 for that purpose. The wall mounts 55 are designed to be permanently attached to the wall surface such as on a back porch or a deck.

It is likely that the male coupler 65 will use a spring loaded push pin so that the tube with the netting can be moved easily from location to location.

In this way, the parent or guardian can move the device from the garage and place it on another area of the house such as a deck, back porch or similar area. Once the tube has been installed on the back porch the parent or guardian simply pulls the netting from the tube to arrange the space desired.

While the embodiments of the invention have been disclosed, certain modifications may be made by those skilled in the art to modify the invention without departing from the spirit of the invention.

The inventor claims:

1. A portable home barrier for enclosing a play area for children, comprising:

a pair of stanchions, each comprising a hollow tubular canister having a retractable mesh netting panel contained therein;

a plurality of netting support posts secured to the ground, the mesh netting panels being extended from the tubular canisters, secured to the netting support posts, and distal ends of the mesh netting panels being secured together to confine children within a designated enclosed area;

a zipper in at least one of the mesh netting panels, the zipper allowing the netting panel to be opened to enable passage therethrough in the extended position without dismantling the barrier;

a pair of canister bracket arms attached to each tubular canister, each canister bracket arm having a bracket post extending downwardly from a distal end thereof and a hole extending through the bracket post for receiving a cotter pin therethrough;

a plurality of wall mounting brackets affixed to opposing interior walls of a garage, each bracket comprising a pair of angled bracket arms each having a mounting flange at a distal end thereof, and an opening extending transversely through a central portion thereof disposed between the bracket arms, each flange having a plurality of apertures for receiving fasteners therethrough to affix the wall mounting brackets to the interior wads of the garage;

wherein in an assembled condition of the tubular canisters with the wall mounting brackets, the bracket post of each respective canister bracket arm is inserted through and pivotably received within the opening of a respective one the wall mounting brackets, and a cotter pin is inserted through the hole of the bracket post to secure the bracket post therein;

wherein when the stanchions are in use, the tubular canisters are assembled with the wall mounting brackets and the tubular canisters are pivoted about the bracket arm posts to a position outward from the interior walls such that the mesh netting panels can be extended; and wherein when the stanchions are not in use, the mesh netting panels are retracted within the tubular canisters, and the tubular canisters are pivoted about the bracket arm posts to a position adjacent the interior walls or the tubular canisters are disassembled from the wall mounting brackets.

2. A portable home barrier for enclosing a play area for children, comprising:

a pair of stanchions, each comprising a hollow tubular canister having a retractable mesh netting panel contained therein;

a plurality of netting support posts secured to the ground, the mesh netting panels being extended from the tubular canisters, secured to the netting support posts, and distal ends of the mesh netting panels being secured together to confine children within a designated enclosed area;

a zipper in at least one of the mesh netting panels, the zipper allowing the netting panel to be opened to enable passage therethrough in the extended position without dismantling the barrier;

a pair of tubular canister bracket arms attached to each tubular canister, each canister bracket arm having a longitudinally-extending hollow interior having an opening disposed at a distal end thereof and a plurality of apertures extending through sidewalls thereof for receiving a grommets therethrough;

a plurality of wall mounting brackets affixed to opposing wall surfaces of a deck or porch, each bracket comprising a tubular bracket arm having a longitudinally-extending hollow interior having an opening disposed at a proximal end thereof and a plurality of apertures extending through sidewalls thereof for receiving a grommets therethrough, and a mounting flange at a distal end thereof, each flange having a plurality of apertures for receiving fasteners therethrough to affix the wall mounting brackets to the wall surfaces of the deck or porch; and a plurality of male couplers, each male coupler having opposing longitudinal ends having a plurality of spring-loaded grommets disposed therein for securing the male couplers within the hollow interiors of the canister bracket arms and wall mounting brackets;

wherein in an assembled condition of the tubular canisters with the wall mounting brackets, a first end of each male coupler is inserted within the opening of a respective one of the canister bracket arms, and a second end of the male coupler is inserted within the opening of a respective one of the wall mounting brackets, such that the spring-loaded grommets are received within respective apertures extending through the sidewalls of the canister bracket arms and wall mounting brackets to secure the male couplers therein;

wherein when the stanchions are in use, the tubular canisters are assembled with the wall mounting brackets at a position outward from the wall surfaces such that the mesh netting panels can be extended; and wherein when the stanchions are not in use, the mesh netting panels are retracted within the tubular canisters, and the tubular canisters may be disassembled from the wall mounting brackets.

* * * * *